US012228377B1

(12) United States Patent
Vu

(10) Patent No.: US 12,228,377 B1
(45) Date of Patent: Feb. 18, 2025

(54) SYSTEM AND METHOD FOR MOUNTING A COMPONENT PACKAGE ON THE FRONT OF A MUNITION

(71) Applicant: Government of the United States, as represented by the Secretary of the Air Force, Wright-Patterson AFB, OH (US)

(72) Inventor: Daniel Vu, Niceville, FL (US)

(73) Assignee: United States of America as represented by Secretary of the Air Force, Wright-Patterson AFB, OH (US)

( * ) Notice: Subject to any disclaimer, the term of this patent is extended or adjusted under 35 U.S.C. 154(b) by 459 days.

(21) Appl. No.: 17/692,603

(22) Filed: Mar. 11, 2022

(51) Int. Cl.
*F41G 7/30* (2006.01)

(52) U.S. Cl.
CPC ..... *F41G 7/306* (2013.01)

(58) Field of Classification Search
CPC ..... F41G 7/306
See application file for complete search history.

(56) References Cited

U.S. PATENT DOCUMENTS

| | | | | |
|---|---|---|---|---|
| 7,533,612 | B1 * | 5/2009 | Papayianis | F42C 11/001 102/211 |
| 8,026,465 | B1 * | 9/2011 | Fraysse, Jr. | F42B 10/54 244/3.22 |
| 8,125,398 | B1 * | 2/2012 | Paulsen | F42B 10/62 343/705 |
| 8,234,979 | B1 * | 8/2012 | Falabella | F42C 11/00 102/275.9 |
| 9,671,200 | B1 * | 6/2017 | Anderson | F41G 7/224 |
| 10,288,395 | B1 * | 5/2019 | Barton | F41G 7/306 |

* cited by examiner

*Primary Examiner* — Marcus E Windrich
(74) *Attorney, Agent, or Firm* — AFMCLO/JAZ; Jeffrey V. Bamber

(57) ABSTRACT

A mounting system is provided for mounting a forward package on the front of a munition. The front of the munition has a plate joined thereto with a beveled aft peripheral surface. The forward package includes a housing that has an aft portion defined by side walls that provides an opening at the rear of the housing. The aft portion of the housing is configured to fit around the periphery of the plate. Fasteners are provided that are engageable with the beveled surface, and are configured to temporarily hold the housing adjacent the forward surface of the plate while permitting rotational adjustment of the housing relative to the plate.

19 Claims, 3 Drawing Sheets

SYSTEM AND METHOD FOR MOUNTING A COMPONENT PACKAGE ON THE FRONT OF A MUNITION

RIGHTS OF THE GOVERNMENT

The invention described herein may be manufactured and used by or for the Government of the United States for all governmental purposes without the payment of any royalty.

FIELD OF THE INVENTION

The present invention relates generally to munitions and, more particularly, to systems and methods for mounting a component package on the front of a munition.

BACKGROUND OF THE INVENTION

In particular mission situations, a munition may be required to have a large structural flat interface at the front of the weapon. There may be a need to mount a component package to the flat interface on the front of the munition. In the scenario of needing a forward instrumentation package (e.g., a seeker sensor, height of burst sensor, or data recorder) traditional legacy interfaces are not available as a mounting option.

In such situations, the method of mounting component package to the flat interface on the front of the munition must be capable of independently indexing the rotation of the component package relative to the flat plate's axial rotation.

Therefore, a need exists for a robust flight worthy method of attaching forward component packages to a flat plate with the critical capability of independently indexing the rotation relative to the flat plate's axial rotation.

SUMMARY OF THE INVENTION

The present invention relates generally to munitions and, more particularly, to systems and methods for mounting a component package on the front of a munition.

While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, a mounting system for mounting a forward package on the front of a munition is provided. The mounting system comprises:

- an attachment device comprising a plate having a forward surface, an aft surface, a center, and a periphery, the periphery of the plate having sides, wherein the plate has a beveled surface where the sides and the aft surface of the plate meet;
- a housing for a forward package, the housing comprising a forward portion, an aft portion, wherein the aft portion has an opening therein defined by side walls, which side walls are sized and configured to fit around the periphery of the plate; and
- a plurality of fasteners for joining the housing to the plate, wherein the fasteners are engageable with the beveled surface, and are configured to temporarily hold the housing adjacent the forward surface of the plate while permitting rotational adjustment of the housing relative to the plate.

A munition having a forward package joined to the front of the munition using the system described herein is provided. In some cases, the housing described herein may also be considered to be a separate invention in its own right that may be joinable to the attachment device. The system can be in the form of interchangeable system of different types of forward packages that can be mounted on munitions. A method for mounting a forward package on the front of a munition case is also provided.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The present invention relates generally to munitions and, more particularly, to systems and methods for mounting a forward package, such as a component package, on the front of a munition.

Figure 1:
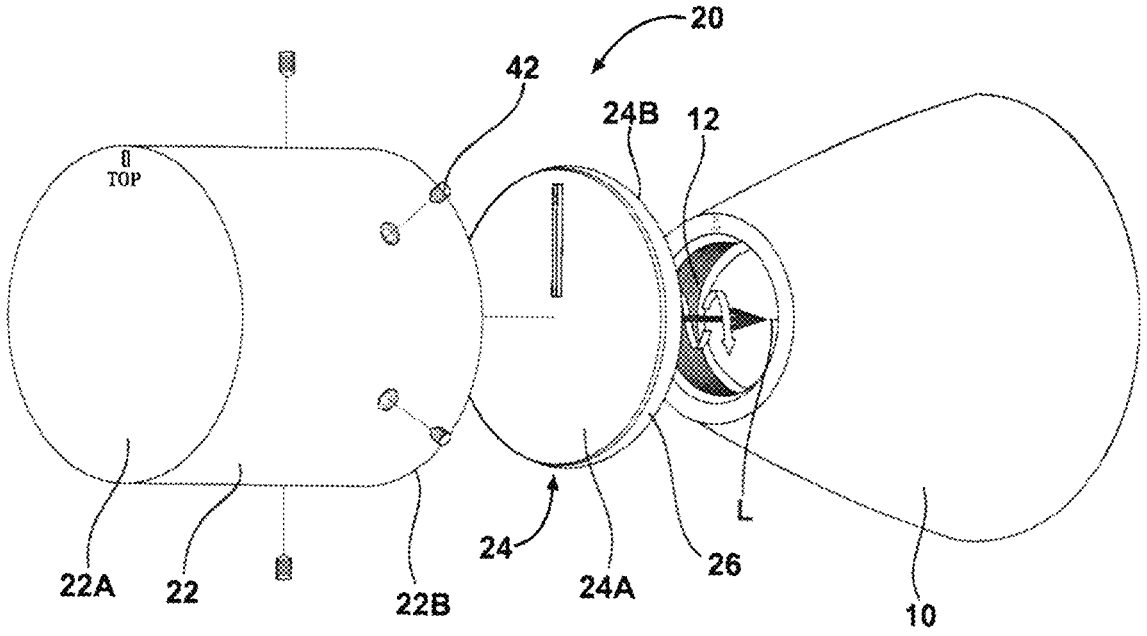
FIG. 1 is a perspective view of one embodiment of a system for mounting a component package on the front of a munition, prior to the component package being mounted.
Figure 2:
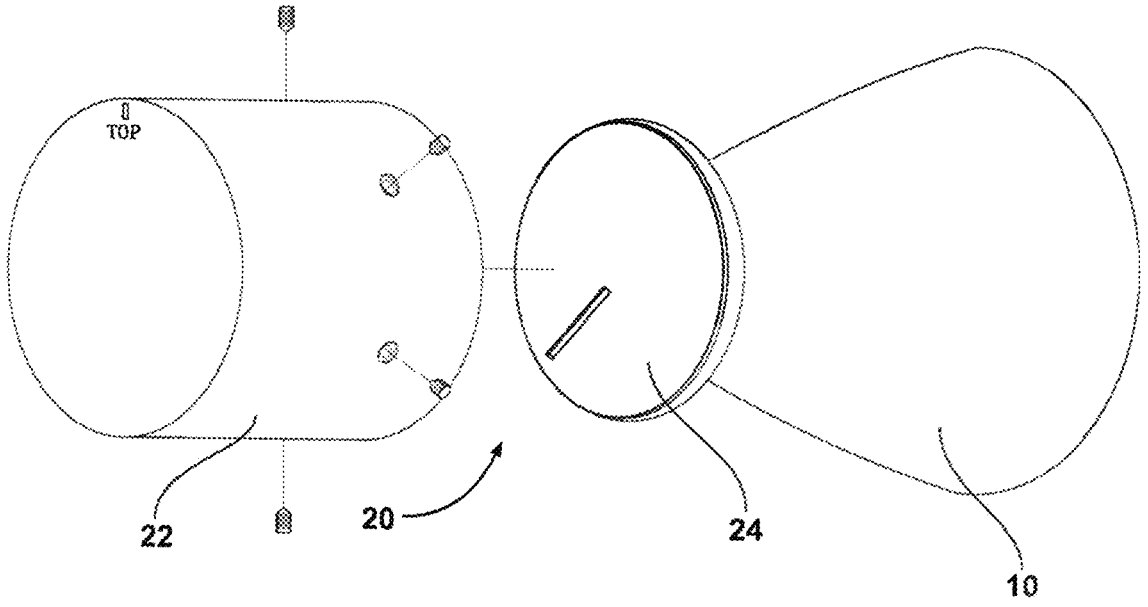
FIG. 2 is a perspective view of the system shown in FIG. 1 showing the plate joined to the front of the munition.
Figure 3:
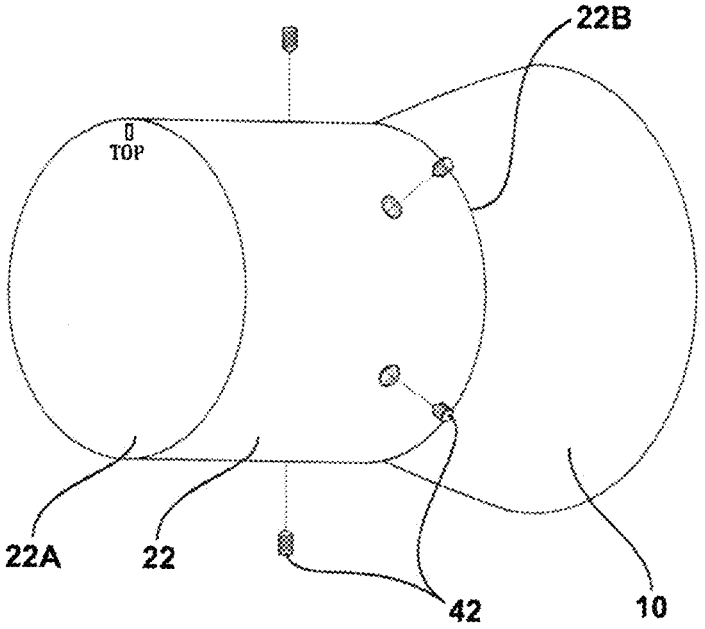
FIG. 3 is a perspective view of the system shown in FIG. 1 showing the component package mounted on the plate on the front of the munition.
Figure 4:
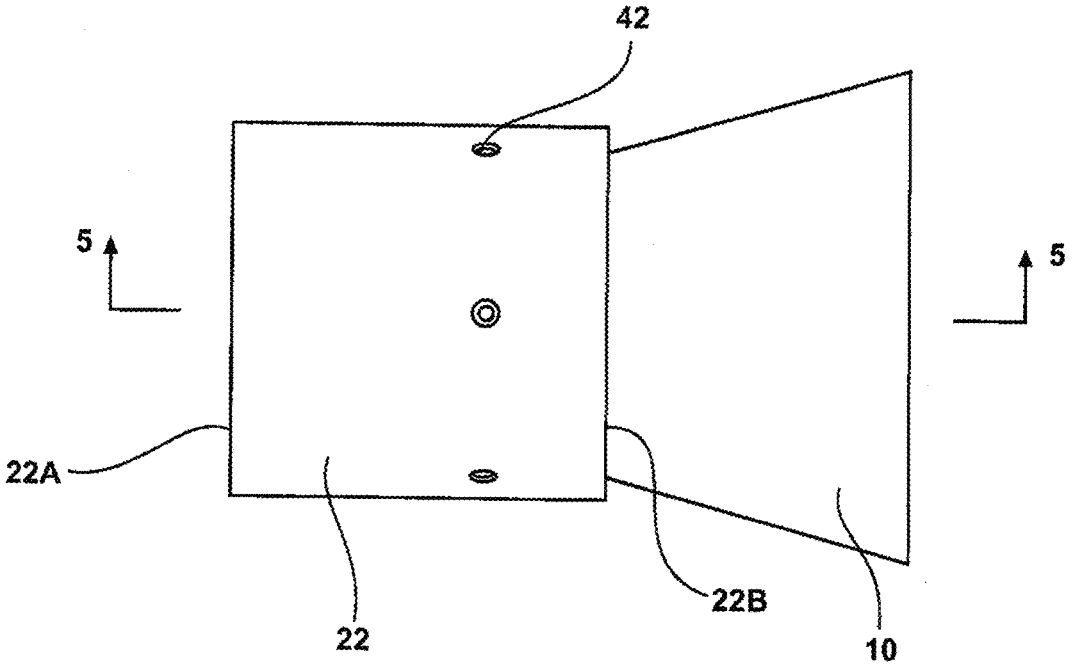
FIG. 4 is a side view of the component package mounted on the front of the munition.

FIG. 1 shows one embodiment of a system 20 for mounting a forward package, such as component package 22 on the front of a munition 10, prior to the component package being mounted. The component package will be mounted on the plate 24 which is joined to the front of the munition 10.

FIG. 1 shows that the munition has an indicia thereon indicating the top of the munition. The component package 22 also has an indicia thereon indicating the top of the component package 22. In this embodiment, the system 20 enables the top of the component package 22 to be aligned with the top of the munition.

The munition 10 can be any type of munition that has a plate joined to the front of the munition. The term "munition", as used herein, refers to large munitions such as missiles, rockets, and bombs. In FIG. 1, only the front portion of the munition is shown. The munition comprises a case having a front end and a longitudinal centerline L. The center of the plate 24 may be aligned with the longitudinal centerline L of the munition case. The plate 24 and the outer, or forward surface 24A of the plate will be oriented substantially perpendicular to the longitudinal centerline of the munition case.

The plate 24 will be joined to the front of the munition 10. The plate 24 can have any suitable configuration. In the embodiment shown, the plate 24 is circular. The plate 24 has a forward surface 24A, an aft surface 24B, a thickness between the forward and aft surfaces, a center, and a periphery. The periphery of the plate 24 forms the sides 26 of the plate. The plate 24 has a beveled surface 28 (shown in FIG. 5) where the sides 26 and the aft surface 24B of the plate meet.

The plate 24 can be joined to the front of the munition 10 in any suitable manner. The way that the plate 24 is joined to the front of the munition is not a key feature of the system. In FIG. 1, the munition comprises a case having a front end with an opening therein. While not a key feature of the system, in the embodiment shown in FIG. 5, the inside surface of the case has a threaded region 12 for receiving a plate 24 that comprises part of a nose insert or plug that has a central extension 30 extending substantially perpendicularly from the center of the aft surface 24B of the plate 24, where at least a portion 32 of central extension 30 is threaded. In the embodiment shown, the central extension 30 is screwed into the threaded opening 12 in the front end of the munition case. The final clocking position of the plug may vary between different munitions due to the threading characteristics of the threaded parts. In other cases, the plate 24 may be built onto the front of the case of the munition.

The forward package 22 can comprise a component package such as an instrumentation package (e.g., one or more of a seeker sensor, height of burst sensor, data recorder, and guidance and control devices). In such cases, the component package 22 may contain electronics. In some cases, the forward package 22 can comprise an air faring, or power supplies instead of, or in addition to, the instrumentation package. The component package 22 comprises a housing having a forward portion 22A and an aft portion 22B. The housing can have any suitable configuration. In the embodiment shown, the housing is generally cylindrical with a generally flat or planar forward portion 22A. In other embodiments, such as when the forward package comprises an air faring, the forward portion 22A of the housing may be pointed, cone-shaped, bullet-shaped, or have any other suitable streamlined configuration. Other portions of such a housing may be generally cylindrical. Although the body of component package 22 is shown schematically in cross-section in FIG. 5 as being solid, it is understood that the body of a component package may have a hollow interior space for housing any of the previously-mentioned types of components.

Figure 5:
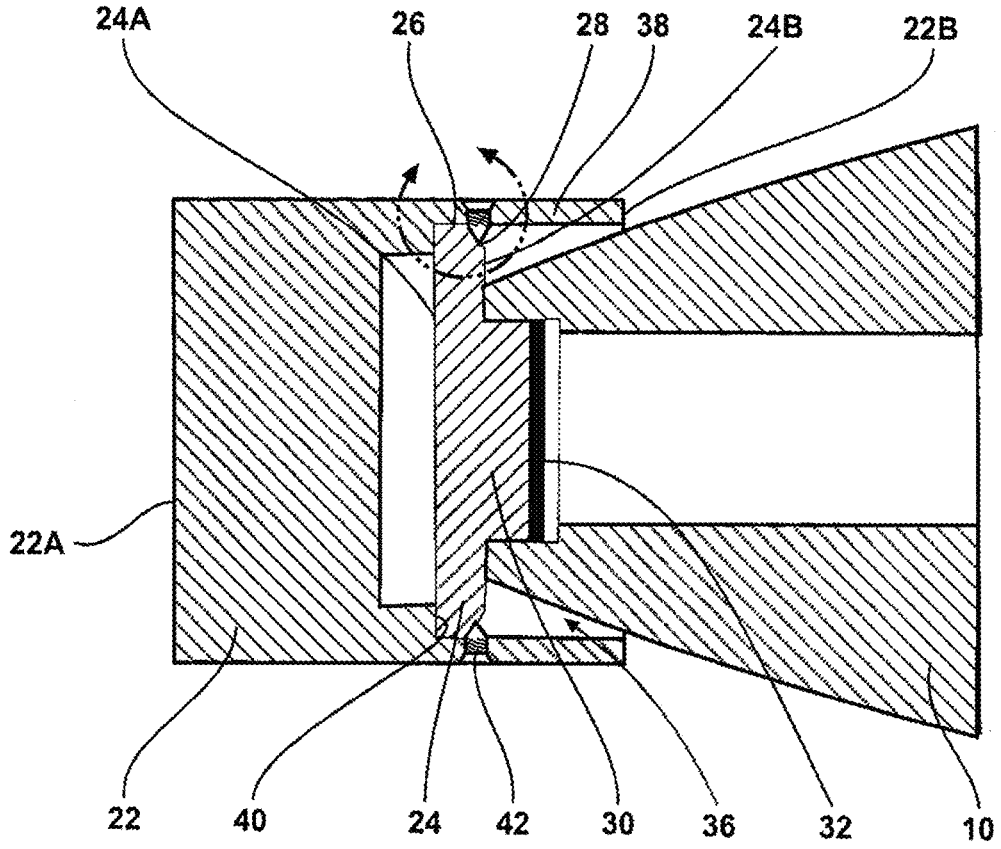
FIG. 5 is a cross-sectional view of the component package mounted on the front of the munition, taken along line 5-5 of FIG. 4.
Figure 6:
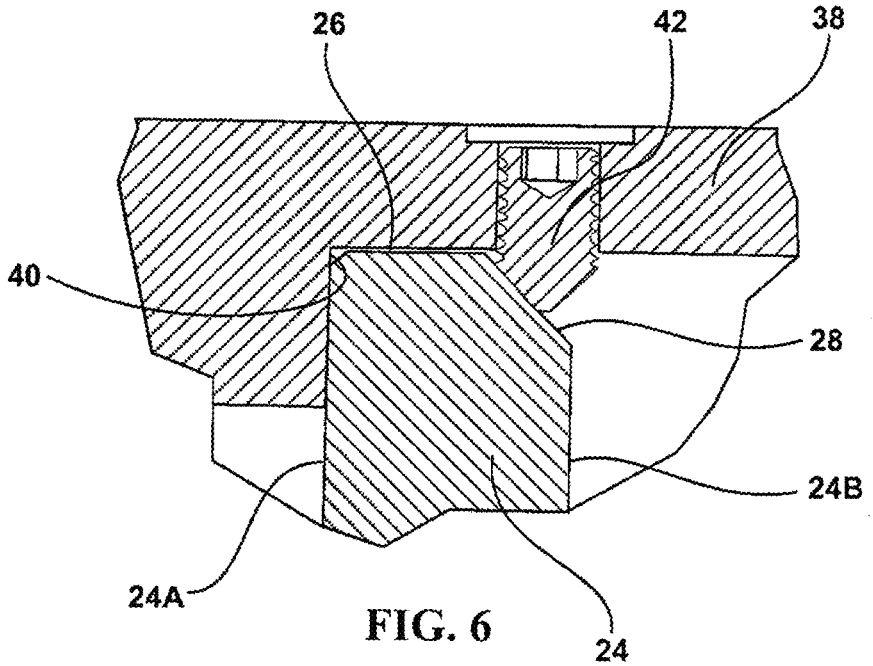
FIG. 6 is an enlarged view of a portion of the cross-section in FIG. 5 showing the details of the fastening system.

FIG. 5 shows that the aft portion 22B has an opening, such as a cylindrical opening 36 therein that is defined by side walls 38 of the aft portion 22B of the housing. The side walls 38 of the aft portion 22B are sized and configured to fit around the periphery of the plate 24. The housing of the component package 22 may also have a shelf 40 inside the opening 36. The shelf 40 can be located around the inside perimeter of the side walls 38. In the embodiment shown, the shelf 40 may only extend inwardly part of the distance toward the central axis of the housing. In other embodiments, the shelf 40 may extend across the entire cross-section of the housing. The forward surface 24A of the plate 24, or portions thereof, may abut the shelf 40. The forward surface 24A of the plate 24 may, as a result, serve as a forward bearing surface against the shelf 40 when the component package 22 is joined to the plate 24.

The side walls 38 of the aft portion 22B of the housing may have a length that extends in the direction of the longitudinal centerline L of the munition case. In the embodiment shown in FIG. 5, the space between the opposing portions of the side walls 38 is such that the side walls 38 fit over the front of the munition case. The ends of the side walls (e.g. to which the lead line for reference number 22B points in FIG. 5) may, in some cases, stop short of contacting the munition case. In other cases, the ends of the side walls 38 may contact the munition case to further stabilize the housing of the component package after it is joined to the plate 24.

The system further comprises a plurality of fasteners 42 for joining the housing to the plate 24. The fasteners 42 are engageable with the beveled surface 28 of the aft side 24B of the plate. The fasteners 42 are configured to temporarily hold the housing of the component package 22 adjacent to the forward surface 24A of the plate while permitting rotational adjustment of the housing relative to the plate. The fasteners 42 can comprise any suitable type of fastener that can serve these purposes. In the embodiment shown, the fasteners 42 comprise set screws having angled tips.

In the embodiment shown, the side walls 38 of the aft portion of the housing have through holes therein, and the fasteners 42 are inserted through the through holes. The through holes may or may not have a threaded interior. The through holes may also have a wider opening near the outer surface of the side walls. The through holes may be configured so that the fasteners 42 may be counter-sunk below the surface of the side walls. While the fasteners 42 can be in any suitable arrangement, in the embodiment shown, the fasteners 42 are disposed radially around the housing. The tips of the set screws contact the beveled surface 28 of the aft side 24B of the plate. Once the component package 22 is in its final position, the screws 42 may be tightened so that the component package 22 is no longer able to rotate relative to the plate 24.

A method for mounting a forward package on the front of a munition case is also provided. In one embodiment, the method comprises:

- providing an attachment device comprising a plate having a forward surface, an aft surface, a center, and a periphery, the periphery of the plate having sides, wherein the plate has a beveled surface where the sides and the aft surface of the plate meet;
- providing a housing for a forward package, the housing comprising a forward portion, an aft portion, wherein the aft portion has an opening therein defined by side walls, which side walls are sized and configured to fit around the periphery of the plate; and
- providing a plurality of fasteners for joining the housing to the plate, wherein the fasteners are engageable with the beveled surface;

positioning the housing over the attachment device so that the side walls of the attachment device fit around the periphery of the plate of the attachment device;

inserting the fasteners through holes in the side walls of the housing for the forward package so that the fasteners contact the beveled surface, and temporarily hold the housing adjacent the forward surface of the plate while permitting rotational adjustment of the housing relative to the plate; rotating the housing to the desired position; and tightening the fasteners.

The systems and methods described herein can provide a number of advantages. It should be understood, however, that these advantages need not be required unless they are set forth in the appended claims. This invention provides a secure flight worthy system and method of attaching forward packages to a flat plate on the front of a munition with the capability of independently indexing the rotation of the package relative to the flat plate's axial rotation (or position). The system and method allows for easy installation in the field of a forward package to a munition by personnel using conventional tools with minimal training. The system and method can also be used to quickly swap one type of forward package on a munition with another type when multiple types of forward packages are configured with the features described herein.

The term "joined", as used herein, encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined" includes both those configurations in which an element is temporarily joined to another element, or in which an element is permanently joined to another element.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A mounting system for mounting a forward package on the front of a munition case, said mounting system comprising:

an attachment device comprising a plate having a forward surface, an aft surface, a center, and a periphery, said periphery of said plate having sides, wherein said plate has a beveled surface where the sides and the aft surface of said plate meet;

a housing for a forward package, said housing comprising a forward portion, an aft portion, wherein said aft portion has an opening therein defined by side walls, which side walls are sized and configured to fit around the periphery of said plate; and a plurality of fasteners for joining said housing to said plate, wherein said fasteners are engageable with said beveled surface, and are configured to temporarily hold said housing adjacent the forward surface of said plate while permitting rotational adjustment of said housing relative to said plate.

2. The mounting system of claim 1 wherein the housing of the forward package contains a component package comprising an instrumentation package.

3. The mounting system of claim 2 wherein the instrumentation package comprises one or more of a seeker sensor, a height of burst sensor, a data recorder, and guidance and control devices.

4. The mounting system of claim 1 wherein the housing of the forward package comprises one or more of an air faring, or power supplies.

5. The mounting system of claim 1 wherein at least the aft portion of the housing is cylindrical.

6. The mounting system of claim 5 wherein the forward portion of the housing is planar.

7. The mounting system of claim 1 wherein the housing has a shelf inside the aft portion opening, wherein the shelf is positioned and configured so that the forward surface of said plate abuts against the shelf.

8. The mounting system of claim 1 wherein the side walls are also sized and configured to fit over a portion of the front of a munition case.

9. The mounting system of claim 5 wherein said side walls of the aft portion of the housing have through holes therein, and said fasteners are inserted through said through holes.

10. The mounting system of claim 9 wherein said through holes and said fasteners are disposed radially around said housing.

11. The mounting system of claim 9 wherein said fasteners comprise set screws.

12. A method for mounting a forward package on the front of a munition case, said method comprising:

providing an attachment device comprising a plate having a forward surface, an aft surface, a center, and a periphery, said periphery of said plate having sides, wherein said plate has a beveled surface where the sides and the aft surface of said plate meet;

providing a housing for a forward package, said housing comprising a forward portion, an aft portion, wherein said aft portion has an opening therein defined by side walls, which side walls are sized and configured to fit around the periphery of said plate; and providing a plurality of fasteners for joining said housing to said plate, wherein said fasteners are engageable with said beveled surface;

positioning the housing over the attachment device so that the side walls of the attachment device fit around the periphery of the plate of the attachment device;

inserting said fasteners through holes in the side walls of the housing for the forward package so that the fasteners contact the beveled surface, and temporarily hold said housing adjacent the forward surface of said plate while permitting rotational adjustment of said housing relative to said plate;

rotating the housing to the desired position; and tightening said fasteners.

13. The method of claim 12 wherein the housing of the forward package contains a component package comprising an instrumentation package.

14. The method of claim 12 wherein the housing of the forward package comprises one or more of an air faring, or power supplies.

15. The method of claim 12 wherein the forward portion of the housing is planar and at least the aft portion of the housing is cylindrical.

16. The method of claim 12 wherein the housing has a shelf inside the aft portion opening, wherein the shelf is positioned and configured so that the forward surface of the plate abuts against the shelf.

17. The method of claim 12 wherein the side walls are also sized and configured to fit over a portion of the front of a munition case.

18. The method of claim 12 wherein said holes and said fasteners are disposed radially around said housing.

19. The method of claim 12 wherein said fasteners comprise set screws.

* * * * *